United States Patent [19]

Jones et al.

[11] 4,309,593

[45] Jan. 5, 1982

[54] ELECTRIC HEATER WHICH REDUCES THE CHANCE OF ELECTRICAL SHOCK

[75] Inventors: Darrell B. Jones, Independence, Mo.; William B. Kircher, Shawnee Mission, Kans.

[73] Assignee: Rival Manufacturing Company, Kansas City, Mo.

[21] Appl. No.: 112,233

[22] Filed: Jan. 15, 1980

[51] Int. Cl.[3] ..... H05B 3/32

[52] U.S. Cl. ..... 219/347; 219/377; 219/342

[58] Field of Search ..... 219/347-348, 219/377, 358, 354, 342; 338/316

[56] References Cited

U.S. PATENT DOCUMENTS

| | | | |
|---|---|---|---|
| 1,553,367 | 9/1925 | Colby | 219/347 |
| 2,467,479 | 4/1949 | Huck | 219/347 |
| 3,019,324 | 1/1962 | Sohn | 219/347 |
| 3,610,882 | 10/1971 | Omohundro | 219/347 |
| 3,619,555 | 11/1971 | Bassett Jr. | 219/347 |
| 3,624,351 | 11/1971 | Kipp | 219/347 |

*Primary Examiner*—Gene Z. Rubinson
*Assistant Examiner*—Bernard Roskoski
*Attorney, Agent, or Firm*—Lowe, Kokjer, Kircher, Wharton & Bowman

[57] ABSTRACT

An electric heater construction which significantly reduced the possibility of electrical shock to a user thereof. This electric heater includes an outer casing with an open front, a protective grille mounted over the open front of the outer casing, a reflector assembly mounted within the outer casing and a heating element enclosure mounted to the reflector assembly such that it is electrically insulated therefrom. A ribbon-type of heating element is mounted within the heating element enclosure. If any portion of the heating element should break or for any other reason become disengaged from the insulated mounted structure, the heating element enclosure effectively prevents it from coming in contact with any non-insulated portion of the device which is readily accessible to a user of the heater thereby protecting a user of the device from electrical shock.

19 Claims, 5 Drawing Figures

ELECTRIC HEATER WHICH REDUCES THE CHANCE OF ELECTRICAL SHOCK

BACKGROUND AND BRIEF DESCRIPTION OF THE INVENTION

This invention relates in general to electric space heaters and, in particular, to the improvement in such heaters which significantly enhance the safety thereof.

Many different types of electrical heaters are disclosed in the prior art. Most of these heaters, however, fall into two main categories. The first group of electrical heaters comprises heaters in which the heating element is helically wound around an insulated member which may be positioned in front of a reflective surface. The heating element and reflective surface (if used) are normally located within an outer casing having an open front so that the heat generated by the heating element is directed outward through the front of the heating device. A protective grille is usually provided to cover the open front of the outer casing.

In a second type of electrical heater, a ribbon type of heating element is normally strung between insulators located at opposite ends of a reflector assembly typically enclosed by an outer casing having an open front through which the heat generated by the heating element is directed. As in the above device, a protective grille is used for covering the open front of the casing.

The heating element is normally strung between insulators on opposing sides of the reflector assembly such that the element traverses the reflective surface of the reflector assembly without any intermediate means of support. To compensate for expansion and contraction of the heating element during use, spring tension keeps same taut at all times. If the heating element should break and deflect or merely become disengaged from its mounting, it is possible for it to come in contact with an electrically conductive portion of the heater such as the outer casing, reflector assembly or protective grille. These portions of the heater may be readily accessible to a user of the heater, thereby offering the possibility of an electrical shock.

The present invention overcomes this possibility by containing the ribbon-like heating element within a heating element enclosure which is electrically insulated from the conductive components of the heating device. If the heating element should break, or inadvertently deflect, the heating element enclosure prevents the current carrying heating element from coming in contact with the heater's outer casing, reflector assembly or protective grille. Accordingly, the heating element enclosure serves to electrically isolate the heating element(s) of the device from any component of the heater which is readily accessible to a user thereof.

The heating element enclosure is comprised of a rectangularly shaped structure having a perforated face, and is mounted to the reflector assembly such that the perforated face of the structure faces toward the open front of the heater's outer casing. The heating element enclosure is electrically insulated from the reflector assembly to electrically isolate the enclosure (and the heating elements) from the remainder of the heating device and is spaced a sufficient distance away from the protective grille within the housing to prevent a user from intentionally or inadvertently contacting it.

It is therefore an object of the present invention to provide an improved heater utilizing one or more ribbon-type heating elements wherein the chance of electrical shock to a user in the event of breakage of a heating element is significantly reduced.

A further object of the present invention is to provide an improved heater utilizing a ribbon-type of heating element wherein the heating element is contained within a heating element enclosure which is electrically insulated from the external components of the device.

Another object of the present invention is to provide an improved heater utilizing a ribbon-type of heating element wherein the heating element is contained within a heating element enclosure which prevents a broken or loose heating element from effecting electrification of any portion of the heater that is readily accessible to a user thereof.

Another object of the present invention is to provide an improved heater having a heating element enclosure with a perforated face which absorbs some of the radiant heat generated by the heating element to lower the temperature at the opening (and grille) in the outer casing of the heater.

Another object of the invention is to provide, in an improved heater of the character described, a plurality of means for spring biasing physically separated heating elements, said means being capable of independent operation.

It is an additional object of the present invention to provide a heater of the character described which is simple and economical to construct.

Other and further objects of this invention, together with the features of novelty appurtenant thereto, will appear in the course of the following description.

DETAILED DESCRIPTION OF THE DRAWINGS

In the accompanying drawings which form a part of the specification and are to be read in conjunction therewith and in which like reference numerals are used to indicate like parts in the various views.

Figure 1:
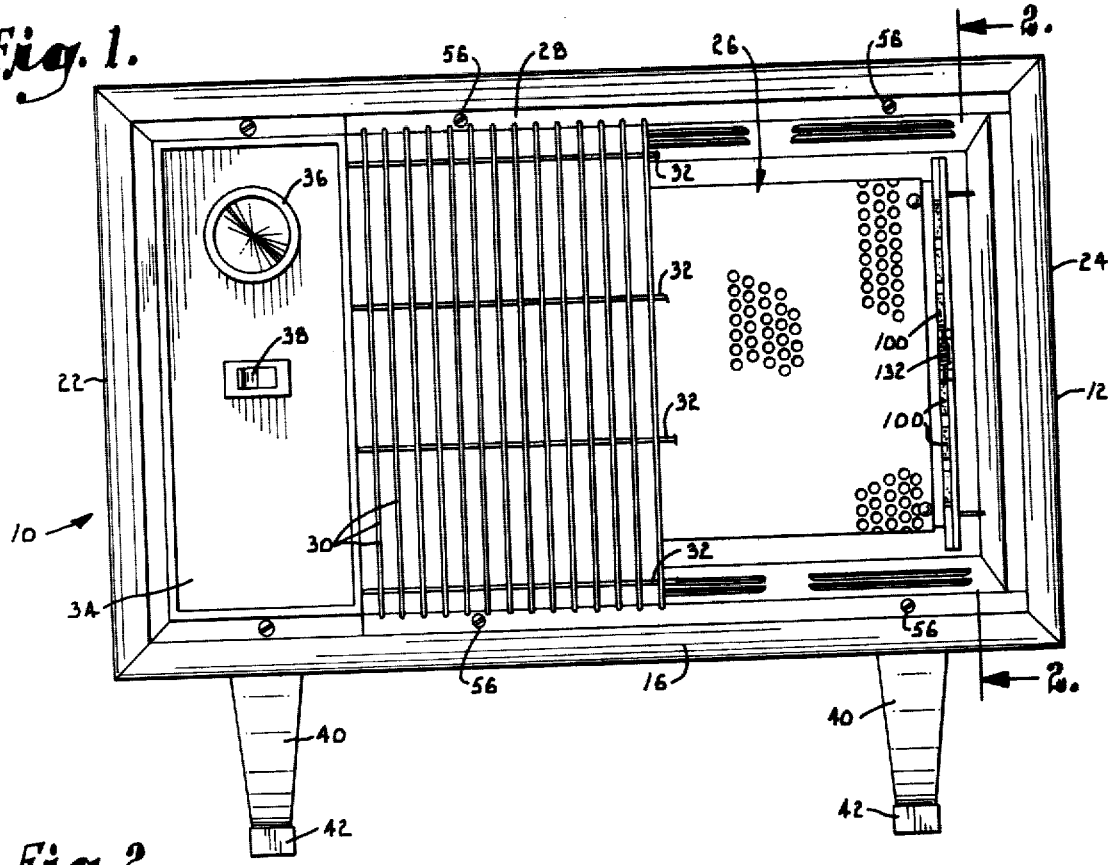
FIG. 1 is a front elevational view of a heater constructed according to a preferred embodiment of the present invention, with portions broken away for the purposes of illustration.
Figure 2:
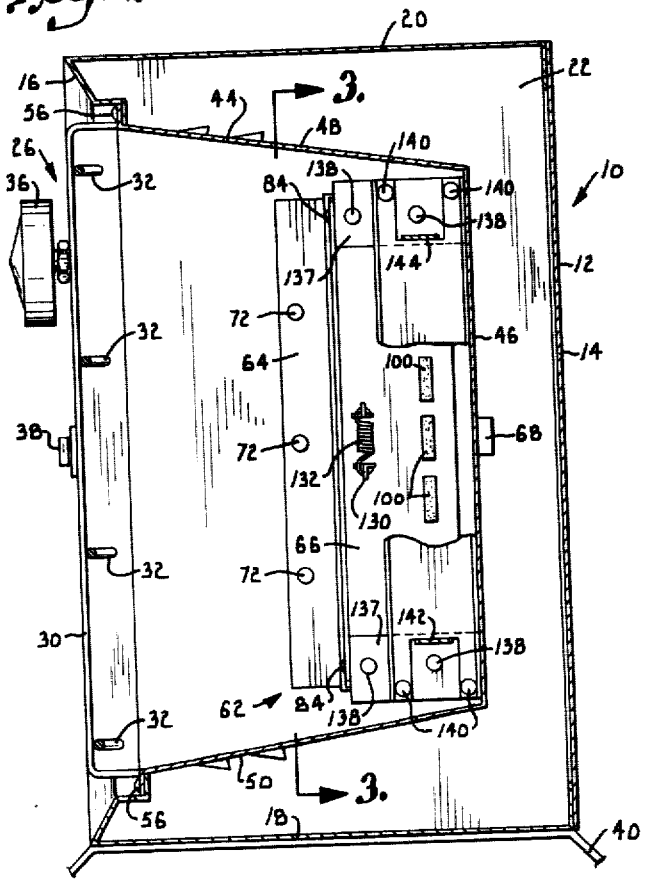
FIG. 2 is a cross sectional view on an enlarged scale taken generally along lines 2—2 of FIG. 1 in the direction of the arrows with portions broken away for the purposes of illustration.
Figure 5:
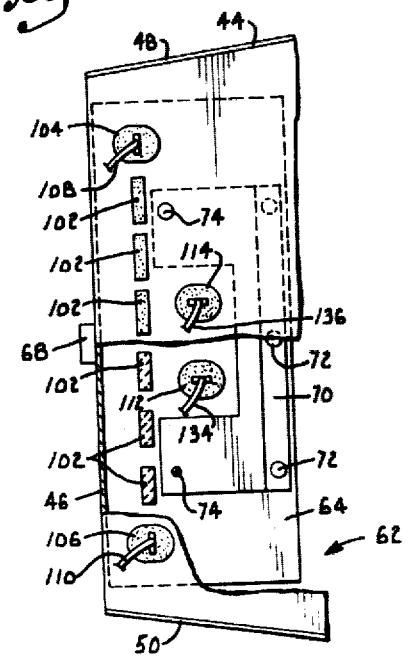
FIG. 5 is a sectional view taken along lines 5—5 of FIG. 3 in the direction of the arrows.
Figure 3:
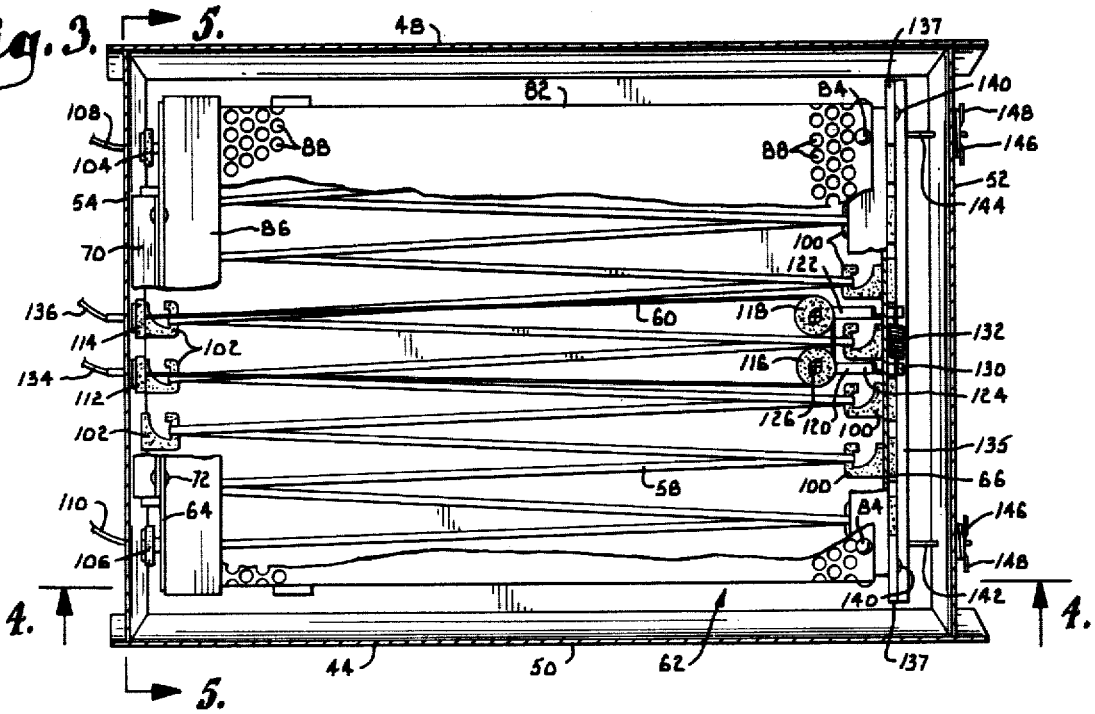
FIG. 3 is a fragmentary sectional view taken generally along lines 3—3 of FIG. 2 in the direction of the arrows with portions broken away for the purposes of illustration.

Referring now to the drawings and initially to FIGS. 1 and 2, numeral 10 is used to generally designate a modular electric space heater which is constructed in accordance with a preferred embodiment of the present invention. The heater is constructed to have an outer metallic casing 12. The outer casing is rectangular in shape and is comprised of a back wall 14, a front wall 16, a bottom wall 18, a top wall 20 and opposing side walls 22 and 24. An opening 26 is provided in the front wall. This opening is in turn covered by a protective grille 28 which is suitably secured to the front wall of the outer casing. While the specific configuration of the grille can take many different forms, the one shown herein is comprised of a plurality of spaced vertical bars 30 which are secured as by welding to a plurality of horizontal bars 32. The configuration of the protective grille should be such that the space between the bars permits air to readily pass therethrough unimpeded, but restricts the passage of foreign objects such as fingers and the like.

The heater also includes a control compartment (designated by the numeral 34 and directed to the front panel member thereof) wherein the conventional components for operating the heater are contained. These components include, for example, a temperature responsive control switch operated by a knob 36 which is accessible from outside the heater and a wattage control switch which is also accessible from outside the heater by means of a switch device 38. A motor driven fan and the conventional electrical wiring is also contained within the control compartment.

The casing is supported by legs 40 which are secured to opposite ends of the casing's bottom wall 18. These legs are provided with cushioning feet 42 which rest on the floor or other support surface.

Referring now principally to FIGS. 2–5, a reflector assembly 44 is mounted within the inner casing of the heater. The reflector assembly is comprised of a reflective surface which is constructed from a piece of sheet metal to have an optional rear wall 46 and a plurality of forwardly projecting side walls 48, 50, 52, and 54. The rear (if used) and side walls of the reflective surface cooperate to form a trapezoidal-shaped structure having a hollow inner cavity. The reflective surface is in turn attached to the front wall of the outer casing by means of a plurality of mounting screws 56. The reflective surface is secured to the outer casing such that the rear wall (or rear opening if the wall 46 is not used) of the surface faces the opening in the front of the casing and such that the hollow inner cavity of the reflector assembly 44 is adjacent to this opening.

A pair of ribbon-like heating elements 58 and 60 are mounted within the interior cavity of the reflector assembly. These heating elements are contained within a heating element enclosure 62 which is suitably mounted within the interior cavity of reflector assembly 44 such that it is electrically insulated therefrom as will be described.

Figure 4:
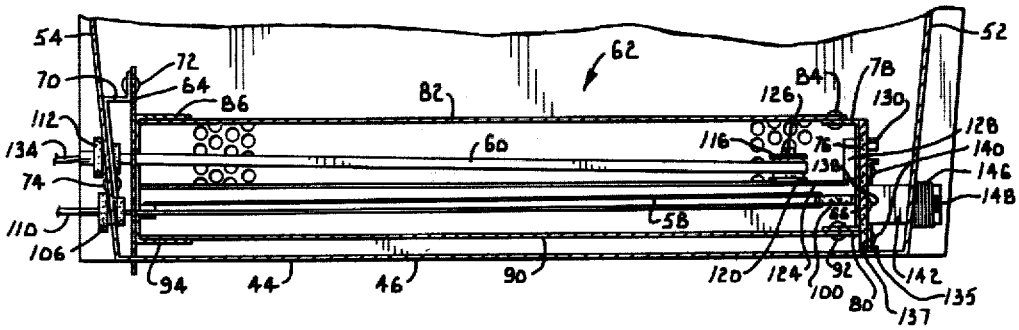
FIG. 4 is a sectional view taken along lines 4—4 of FIG. 3 in the direction of the arrows.

The heating element enclosure is comprised of a pair of opposing end walls 64 and 66 (see FIG. 4). End wall 64 is constructed of mica or some other type of nonconductive material which can be formed into a rigid piece. This wall has a tab 68 (FIGS. 4 and 5) integrally formed therewith. This tab in turn fits within a slot (not shown) in the rear wall 46 of reflector assembly 44 to secure one edge of end wall 64 to the reflector assembly 44. (If the rear wall 46 is eliminated, similar side wall mounting could be used). The other end of end wall 64 is in turn secured to side wall 52 of the reflector assembly by means of a mounting bracket 70. (Alternatively, tabs may be formed up directly from side wall 52 of the reflector assembly and be secured to end wall 64 by being inserted through slots and bent over). One end of mounting bracket 70 is secured to end wall 64 by means of a plurality of rivets or by bent over tabs 72 while the other end of this bracket is secured to side wall 52 of reflector assembly 44 by means of a plurality of rivets or by tabs 74. End wall 66, on the other hand, is comprised of a channel shaped bracket having a base portion 76 and a pair of extending portions 78 and 80.

A face plate 82 is in turn attached to the extending portion 78 of end wall 66 by means of rivets or tabs 84 and located within the confines of flange 86 (formed from a portion of end wall 64). The length dimension of the plate 82, in conjunction with the later described spring tension on the heating element limits the positioning of plate 82 with respect to flange 86. With this mounting arrangement, plate 82 is permitted to move laterally with end wall 66 as same may move with the expansion or contraction of the heating elements. The face plate is provided with a plurality of perforations (or apertures) 88 which substantially covers the entire area thereof and has a portion of each lateral side bent over so that it covers at least a portion of its corresponding side of the enclosure. Each of the above mentioned perforations is circular in shape, and of a diameter smaller than the width of heating element 58 or heating element 60. (Alternatively, the face plate 88 could be constructed of a wire mesh with the apertures between the wires similarly sized to the above mentioned perforations).

A back plate 90 (FIG. 4), normally having a reflective surface, is attached to the extending portion 80 of end wall 66 by means of rivets or tabs 92. A portion of each lateral side of the bottom plate is bent out as described above with respect to the face plate mount wherein the bent out portions of the bottom plate cooperate with the bent over portions of the face plate to form the lateral side walls of the heating element enclosure.

Heating element 58 is a ribbon-type of heating element which is comprised of a single continuous strand of electrically conductive material or a plurality of individual strands which are electrically coupled with each other in series. This heating element (58) is carried by a first group of non-conductive insulators 100 (conveniently made of Steatite) which are mounted to end wall 66 of the heating element enclosure, a second group of non-conductive insulators 102 extend through a slot in end wall 64 and are mounted on the side wall 54 of reflector 44, and a pair of non-conductive insulators 104 an 106 which are mounted to side wall 54 of the reflector assembly and serve to anchor the heating element.

As mentioned above, one end of the heating element is anchored by insulator 104. From insulator 104, the heating element enters the heating element enclosure through a slot (not shown) in end wall 64. Within the heating elemen' enclosure, the heating element is alternately strung between the insulators of the first and second groups such that the heating element traverses the back plate 90 of the heating element enclosure without any intermediate means of support. Heating element 58 exits the heating element enclosure through a second slot (not shown) in end wall 64 and has its other end anchored by insulator 106. A pair of conductor lines 108 and 110 are electrically coupled with the opposite ends of the heating element at insulators 104 and 106, respectively. These conductor lines are used to supply electrical current to the heating element.

Heating element 60, also a ribbon-type of heating element, preferably is formed by a single continuous strand of metal. One end of this heating element (60) is terminated and supported by a non-conductive insulator 112 while the other end of this heating element is terminated and supported by a second non-conductive insulator 114. Both of these insulators are mounted in the side wall 54 of the reflector assembly. From insulator 112, the heating element enters the heating element enclosure through an opening (not shown) in end wall 64 of the heating element enclosure. Heating element 60 then passes around a second set of two non-conductive insulators 116 and 118 which are also constructed to have a pulley-like configuration. The heating element than traverses the back plate 90 of the heating element enclosure, is spaced forwardly of element 58, and exits the heating element enclosure through an opening (not shown) in the end wall 64 of the enclosure before being terminated and supported by insulator 114 on side wall 54.

Insulators 116 and 118 are in turn mounted to end wall 66 of the heating element enclosure by means of mounting bracket 120 and 122, respectively. Mounting bracket 120 is a U-shaped bracket having intermediate portion 124 separating two extending arms 126 and 128. A mounting flange 130 projects outward from the top of extending arm 128 at a right angle therewith. Extending arm 126 of the bracket is received by an opening in insulator 116 to thereby mount this insulator in place on the mounting bracket. The insulator is secured in place on arm portion 126 by two tabs extending from arm 126 through insulator 116. The tabs may then be bent over to fixedly locate the insulator. The bracket (120) is in turn mounted to end wall 66 of the heating enclosure by passing mounting flange 130 through a corresponding slot in the end wall such that a portion of this arm projects past the end wall. Once mounting flange 130 has been positioned within its corresponding slot, the upper portion of the arm which extends past the end wall 66 is bent over to retain the bracket in place on the wall. However, flange 130 is appropriately bent to permit it to pivot about its mounting slot in the direction necessary to accommodate expansion and contraction of heating element 60. Insulator 118 is mounted to end wall 66 in the same manner by mounting bracket 122 which is constructed to have the same configuration as mounting bracket 120.

A spring 132 is attached to the portion of each bracket which extends beyond end wall 66. This spring operates to force insulators 116 and 118 away from each other and serves to provide a means for effectively compensating for expansion and contraction of the heating element during use.

A conductor line (134 and 136) is attached to each end of heating element 60 at insulators 112 and 114, respectively. These electrical conductor lines are operable to provide electrical current to this heating element.

To compensate for the natural expansion and contraction of heating element 58 during use, the heating element is maintained under constant tension to keep it taut at all times. The heating element is maintained under tension by resiliently coupling the end wall 66 of the heating element enclosure to the side wall 52 of the reflector assembly. To accomplish this coupling, end wall 66 is attached to a mounting plate 135 such that it is electrically insulated therefrom.

One technique for attaching the end wall 66 to mounting plate 135 is shown herein. In particular, a strip of non-conductive material 137 (such as mica or the like) is interposed between end wall 66 and mounting plate 135 at each end of the end wall. As shown in FIG. 4, each strip of non-conductive material extends past the rear edge of the end wall 66 a sufficient distance to keep the wall or any part of the heating element enclosure from coming in contact with the reflector assembly. Both strips of non-conductive material are secured to end wall 66 by rivets 138 and to mounting plate 135 by rivets 140. In this manner the rivets (138) are not allowed to come in contact with any part of the mounting plate 135 and the rivets 140 which are to be used to secure each strip of insulating material to the mounting plate 135 are not allowed to come in contact with any part of end wall 66. Accordingly, end wall 66 is electrically isolated from the mounting plate and from any part of the reflector assembly.

Mounting plate 135 is provided with a pair of mounting arms 142 and 144. These arms are formed from "cutout" portions of mounting plate 135, which extend outwardly therefrom at a right angle with the face of the mounting plate 135. Each mounting arm (142 and 144) in turn passes through a corresponding slot (not shown herein) in side wall 62 of the reflector assembly such that a portion of each arm extends beyond the outer surface thereof. A compression spring 146 is then placed over the outwardly extending portion of each mounting arm. A locking pin 148 is used to secure the spring in place on the mounting arm. In this manner, the compression springs impart a resilient force to end wall 66 of the heating element enclosure which pulls the wall away from opposing wall 64 of the heating element enclosure thereby keeping the heating element taut at all times.

In operation, an electric current is supplied to heating elements 58 and 60 by means of conductor lines 108, 110 and 134, 136 respectively. Accordingly, these resistance type heating elements may be used to generate radiant heat in the conventional manner. The heat thus generated is directed outward through the open front of the heater by means of the reflector assembly and the reflective surface of back plate 90. It should be noted that the perforated face plate 82 blocks a portion of the radiant energy generated by the heat elements. This in turn causes plate 82 to act as a converter which changes a portion of the radiant into convective heat for eventual dispersal into a room or space.

The above mentioned fan assists in creating air flow past plate 82 for improved heat transfer outwardly therefrom. It should be noted that optional rear wall 46 of reflector 44, is provided with suitable openings to allow airflow from the fan. Likewise plate 82 does block or screen a portion of the heating element(s) from directly radiating heat to the front of the heater. In this manner excessive radiant heat transfer is minimized to heat absorbing bodies which may become overheated due to close proximity to the front of the heater.

It is contemplated that suitable controls be used to cause either both elements 58 and 60 to be simultaneously energized or only element 58 to be energized. This will afford wattage alternatives during normal use of the heater. Likewise additional elements may be added which may or may not be energized, affording many wattage alternative possibilities.

If either heating element should break or become disengaged from its mounting means, the heating element enclosure 62 prevents same from coming in contact and electrifying any portion of the heater which is readily accessible to a user thereof. Even if a broken heating element comes in contact with any portion of the heating element enclosure, the remainder of the heater is electrically isolated. As a result, the heater of the present invention serves to significantly eliminate any chance of electrical shock to the user of the device as a result of breakage, deflection or disengagement of the heating element(s).

Also, the present invention serves to significantly reduce chance of electrical shock to the user of the device as a result of the user accidentally or intentionally inserting some conductive material through the grille, in the direction of the heating elements due to the presence of the heating element enclosure which would serve as an additional barrier and deterrent to any such inserted item.

From the foregoing, it will be seen that this invention is one well adapted to attain all ends and objects herein above set forth together with the other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described the invention, we claim:

1. In an electric heater having an outer casing with an open front, the improvement comprising:

a protective grille attached to the outer casing and covering a substantial portion of said open front;

a reflector mounted within the casing;

a heating element enclosure having a perforated face;

means for mounting said heating element enclosure within an operative proximity of said reflector and for electrically insulating said enclosure from said reflector and for preventing said heating element from contacting said reflector in the event said heating element becomes broken, disengaged or abnormally deflects, the apertured face of said heating element enclosure outwardly facing the open front of said outer housing; and a ribbon-type heating element mounted within said heating element enclosure and electrically insulated from said casing said enclosure having substantially the entire heating element mounted therein.

2. An electric heater as in claim 1 including means for spring biasing said heating element.

3. The electric heater as in claim 1 wherein said heating element enclosure comprised of:

a reflective rear wall, means for mounting said apertured face in a spaced apart relationship with respect to said reflective rear wall.

4. The combination as in claim 3 including means for urging said heating element to a taut condition.

5. The combination as in claim 3 wherein said enclosure has at least a portion thereof that is movable with respect to said reflector, said movable portion carrying said heating element mounted thereon and operable to permit expansion or contraction of said element.

6. An electric heater as in claim 1 wherein said heating element enclosure is comprised of:

a first end wall constructed of a non-conductive material, said first end wall being fixedly mounted onto said reflector;

a second end wall movably coupled with said reflector such that said second end wall is electrically insulated from said reflector, said apertured face having apertures distributed over substantially its entire outwardly facing area, said face being attached to said second end wall and located between said heating element and said protective grille; and a bottom plate attached to said second end wall and located between said heating element and said reflector.

7. An electric heater as in claim 6 including means for applying a resilient force to said second end wall, said force operable to urge said second end wall and said face away from said first end wall.

8. The electric heater as in claim 6 wherein said heating element is alternately strung between the first and second end walls of said heating element enclosure in the sinuous configuration.

9. The electric heater as in claim 8 including means for resiliently forcing said second end wall away from said first end wall to maintain said heating element under tension.

10. The combination as in claim 6 including a second heating element mounted within said enclosure, and means for urging said second heating element to a taut condition.

11. The combination as in claim 7 wherein said second element urging means includes a means for pivotally mounting said second element to said second end wall.

12. An electric heater comprising:

an outer casing with an open front;

a protective grille attached to said outer casing and covering said open front;

a reflector having an inner cavity formed by a rear surface and being at least partially reflective and a plurality of side reflective surfaces extending outwardly from the periphery of said rear surface, said reflector being mounted within said outer casing such that said inner cavity is adjacent to the open front of said outer casing;

a ribbon-type of heating element; and means for mounting said heating element within the inner cavity of said reflector and for preventing said heating element from contacting said reflector in the event said heating element becomes broken, disengaged from said mounting means or abnormally deflects, said mounting means including a heating element enclosure which substantially encloses the entire heating element therein, said enclosure being mounted within the inner cavity of said reflector and further including means for electrically insulating said enclosure from said reflector.

13. An electric heater as in claim 12 including tension means for urging said heating element to a taut condition.

14. The combination as in claim 12 wherein said heating element enclosure includes:

a first end wall constructed of a non-conductive material, said first end wall being fixedly mounted onto said reflector;

a second end wall movably coupled with said reflector such that said second end wall is electrically insulated from said reflector, said apertured face having apertures distributed over substantially its entire outwardly facing area, said face being attached to said second end wall and located between said heating element and said protective grille; and a bottom plate attached to said second end wall and located between said heating element and said reflector.

15. An electric heater as in claim 14 including means for applying a resilient force to said second end wall, said force operable to urge said second end wall and said face away from said first end wall.

16. The electric heater as in claim 14 wherein said heating element is alternately strung between the first and second end walls of said heating element enclosure in the sinuous configuration.

17. The electric heater as in claim 16 including means for resiliently forcing said second end wall away from said first end wall to maintain said heating element under tension.

18. The combination as in claim 15 including a second heating element mounted within said enclosure, and means for urging said second heating element to a taut condition.

19. The combination as in claim 17 wherein said second element urging means includes a means for pivotally mounting said second element to said second end wall.

* * * * *